US008938984B2

(12) United States Patent
Probst et al.

(10) Patent No.: US 8,938,984 B2
(45) Date of Patent: Jan. 27, 2015

(54) REFRIGERATOR UNIT AND/OR FREEZER UNIT

(75) Inventors: Arnulf Probst, Altenstadt (DE); Bernd Brussing, Neu-Ulm (DE)

(73) Assignee: Liebherr-Hausgerate Ochsenhausen GmbH, Ochsenhausen (DE)

( * ) Notice: Subject to any disclaimer, the term of this patent is extended or adjusted under 35 U.S.C. 154(b) by 1389 days.

(21) Appl. No.: 12/523,616

(22) PCT Filed: Jan. 17, 2008

(86) PCT No.: PCT/EP2008/000340

§ 371 (c)(1),
(2), (4) Date: Sep. 22, 2010

(87) PCT Pub. No.: WO2008/087028

PCT Pub. Date: Jul. 24, 2008

(65) Prior Publication Data

US 2011/0000242 A1 Jan. 6, 2011

(30) Foreign Application Priority Data

Jan. 19, 2007 (DE) ..... 20 2007 000 824 U
Feb. 13, 2007 (DE) ..... 20 2007 002 134 U
Feb. 16, 2007 (DE) ..... 20 2007 002 350 U

(51) Int. Cl.
*F25D 23/00* (2006.01)
*F25D 27/00* (2006.01)
*F25D 29/00* (2006.01)

(52) U.S. Cl.
CPC ..... *F25D 27/00* (2013.01); *F25D 29/005* (2013.01)
USPC ..... 62/264; 62/440

(58) Field of Classification Search
CPC ..... F25D 29/005; F25D 27/00; F25D 11/00
USPC ..... 62/264, 131, 440, 465; 315/291, 362; 362/545, 612
See application file for complete search history.

(56) References Cited

U.S. PATENT DOCUMENTS

| | | | | |
|---|---|---|---|---|
| 2,515,584 | A | 7/1950 | Benson | |
| 2,644,314 | A | 7/1953 | Schumacher et al. | |
| 4,917,256 | A | 4/1990 | Kruck et al. | |
| 4,939,352 | A * | 7/1990 | Sunyich | 235/382 |
| 4,970,870 | A * | 11/1990 | Midlang et al. | 62/126 |
| 5,009,081 | A * | 4/1991 | Kruck et al. | 62/264 |
| 5,177,976 | A | 1/1993 | Lim et al. | |
| 5,421,247 | A * | 6/1995 | Shim | 99/468 |

(Continued)

FOREIGN PATENT DOCUMENTS

| | | |
|---|---|---|
| CN | 1060708 A | 4/1992 |
| CN | 2175385 | 8/1994 |

(Continued)

*Primary Examiner* — Mohammad M Ali
(74) *Attorney, Agent, or Firm* — Dilworth & Barrese, LLP.

(57) ABSTRACT

The invention relates to a refrigerator unit and/or a freezer unit comprising at least one operating and/or control unit for the operation and/or control of the refrigerator unit and/or freezer unit and/or comprising at least one evaporator module for the cooling of the inner space of the unit as well as comprising illumination means by means of which the inner space of the unit and/or the region located in front of the inner space of the unit from the viewpoint of the user can be illuminated at least partly, wherein the illumination means are arranged in or at the operating and/or control unit and/or in or at the evaporator module.

19 Claims, 3 Drawing Sheets

(56) References Cited

U.S. PATENT DOCUMENTS

| | | | | |
|---|---|---|---|---|
| 5,736,686 | A * | 4/1998 | Perret et al. | 178/18.11 |
| 5,768,898 | A * | 6/1998 | Seok et al. | 62/132 |
| 6,351,964 | B1 * | 3/2002 | Brancheau et al. | 62/249 |
| 6,539,727 | B1 * | 4/2003 | Burnett | 62/78 |
| 6,550,257 | B1 * | 4/2003 | Goetzinger et al. | 62/78 |
| 6,557,356 | B2 * | 5/2003 | Underwood | 62/78 |
| 6,658,884 | B2 * | 12/2003 | Takahashi et al. | 62/264 |
| 7,107,779 | B2 * | 9/2006 | Avenwedde et al. | 62/264 |
| 7,121,675 | B2 * | 10/2006 | Ter-Hovhannisian | 362/92 |
| 7,758,811 | B2 * | 7/2010 | Durack et al. | 422/73 |
| 2003/0019222 | A1 * | 1/2003 | Takahashi et al. | 62/131 |
| 2004/0103584 | A1 * | 6/2004 | Freeman | 49/334 |
| 2005/0127177 | A1 * | 6/2005 | Dearing et al. | 235/385 |
| 2005/0151489 | A1 * | 7/2005 | Lys et al. | 315/308 |
| 2005/0194437 | A1 * | 9/2005 | Dearing et al. | 235/382 |
| 2009/0090121 | A1 | 4/2009 | Hecht et al. | |
| 2009/0133425 | A1 | 5/2009 | Goerz et al. | |

FOREIGN PATENT DOCUMENTS

| | | | |
|---|---|---|---|
| CN | 2757067 | A1 | 2/2006 |
| CN | 1740707 | A | 3/2006 |
| DE | 10103669 | | 8/1957 |
| DE | 1451030 | | 4/1969 |
| DE | 2055691 | | 5/1972 |
| DE | 3925676 | | 2/1991 |
| DE | 29914037 | | 12/2000 |
| DE | 102005017120 | | 10/2006 |
| DE | 102005032976 | | 10/2006 |
| GB | 724638 | | 2/1955 |
| WO | 2007/062910 | | 6/2007 |

* cited by examiner

REFRIGERATOR UNIT AND/OR FREEZER UNIT

BACKGROUND OF THE INVENTION

The present invention relates to a refrigerator unit and/or a freezer unit comprising an operating and/or control unit for the operation and control of the refrigerator unit and/or freezer unit and/or comprising an evaporator module for the cooling of the inner space of the unit and having illumination means by means of which the inner space of the unit and/or the region located in front of the inner space of the unit from the viewpoint of the user can be at least partly illuminated.

It is known from the prior art to illuminate the inner space, i.e. the refrigerating space and/or freezing space of refrigerator units and/or freezer units, with the illumination unit generally being arranged in the inner space of the unit and being activated when the door or hatch of the unit is opened. It is furthermore known from the prior art to use illumination devices which can be folded open and which are pivoted inwardly and outwardly on the opening and closing of the door. These mechanical solutions, however, have the disadvantage that they are expensive and that the mechanism is comparatively prone to breakdown.

SUMMARY OF THE INVENTION

It is therefore the object of the present invention to further develop a refrigerator unit and/or a freezer unit of the initially named kind such that the illumination is made in an efficient manner less prone to breakdown.

This object is solved by a refrigerator unit and/or a freezer unit having the features herein. Provision is accordingly made that the illumination means are arranged in or at the operating and/or control unit and/or in or at the evaporator module. Provision is thus made in accordance with the invention that the illumination is integrated in the operating or control unit or in the evaporator module and that thus a combination of illumination and of operating or control unit or evaporator module is used.

This combination can be used in accordance with the invention both in units which have a control in the inner space and in units which have a control or operating unit outside the inner space.

The advantages of an assembly of illumination means and operating and/or control unit are inter alia cost advantages due to a simpler installation and a lower variety of parts as well as a lower effort and/or cost for construction of the complete assembly with unit operation or control and illumination. The same applies accordingly to an assembly of illumination means and of the named evaporator module.

The term of the "region located in front of the inner space of the unit from the viewpoint of the user" stands for any desired region in front of the inner space of the unit which can e.g. include the region in which pulled out trays or drawers are located so that the illumination in this embodiment of the invention serves inter alia to illuminate the goods located in the drawers or on the trays. The region in which the opened door is located can also be covered. It is thus conceivable, for example, that the illumination means of the refrigerator unit and/or freezer unit in accordance with the invention can also serve for an illumination of the inner side of the opened unit door, for example for an illumination of the door pockets.

The term "illumination means" includes any desired illuminants such as light bulbs and in particular also LEDs.

Provision is thus made in a further embodiment of the invention that the illumination means are formed by one or more LEDs or include one or more LEDs. In a particularly preferred embodiment, LEDs are thus used for the illumination which inter alia have the advantage that they are small and can therefore also be used in tight space conditions since LEDs have a comparatively small heat development. Arrangements of the illumination are thus also possible in very tight space conditions due to the use of one or more LEDs.

The operating and/or control unit can be arranged inside or also outside of the unit. It is, for example, conceivable to form the operating and/or control unit in the form of a band at the front side above the refrigerated inner unit space.

It is conceivable that the operating and/or control unit is arranged above the refrigerated inner unit space. It can, for example, be arranged in a region which is hidden by the door when the door is closed.

Provision is made in a further embodiment of the invention that the operating and/or control unit or the evaporator module has a cut-out and that the illumination means are arranged such that they emit light through the cut-out.

Provision can furthermore be made that the illumination means are located at the lower side or at the front side of the operating and/or control unit and/or of the evaporator module or that the illumination means are located within the operating and/or control unit and/or of the evaporator module and are arranged such that they emit light through a cut-out in the lower side or in the front side of the operating and/or control unit and/or of the evaporator module. It is thus conceivable, for example, to arrange the operating and/or control unit in an upper region of the unit, for example at eye level, and to provide the illumination such that it emits light to the bottom and/or front when the door of the unit is open. The same applies accordingly to the embodiment of the evaporator module of the refrigerator unit and/or freezer unit in accordance with the invention.

The operating and/or control unit and/or the evaporator module can have a panel which forms at least the front-side cover of the operating and/or control unit or of the evaporator module. It is conceivable that the illumination means are arranged in or at the panel as well as also that the cut-out through which the light is emitted is arranged in the panel.

Provision is made in a further embodiment of the invention that the illumination means or an illumination unit which includes the illumination means terminates flush with the operating and/or control unit and/or with the evaporator module or with the panel or projects with respect to it. The illumination can thus be made unobtrusive, flush or, for example, projecting slightly. As stated, due to the preferred use of one or more LED illuminants, embodiments are also possible in very tight space conditions.

Provision is made in a further embodiment of the invention that the illumination is provided by two illuminants or by more than two illuminants which are arranged such that they emit light in different directions. There is a possibility due to different angles of radiation of the light to apply light effects with a precise focus with a depth effect, for example to drawers or also, for example, into the inner space of the unit.

Provision is made in a further embodiment of the invention that the operating and/or control unit and/or the evaporator module has/have a panel made of transparent material. A transparent material can thus be used for the panel, which brings about the advantage that any cover of the illumination unit and of the named panel can be made from one part. Provision can be made in this respect that regions of the panel which should not be transparent are covered by printing, lacquering or in a spraying process via the in-mold process.

The arrangement in accordance with the invention of illumination means in or at the operating and/or control unit and/or at the evaporator module brings along the advantage that certain light effects can be produced. It is thus conceivable, for example, to highlight logos, symbols and prints and the like by backlighting. This can, for example, take place by utilization of scattered light of the named illumination in the inner space of the operating or control unit or of the panel or also by a direct backlighting, for example by application of light conductors which start from the illumination means.

Provision is made in a further embodiment of the invention that the illumination means are connected to an electrical assembly which controls or supplies at least one further component in addition to supplying the illumination means. The illumination means, for example the LEDs, which are required for the illumination can be integrated onto an already present board of the assembly, such as the operating part board. A separate board for the illumination is thus not necessary. A cost-effective unit is thus created by the use of an existing board plus illumination. It is likewise possible to make use of existing standard assemblies in the illumination in the operating or control unit or in the evaporator module. They can, for example, be standardized components or illumination assemblies, in particular LED illumination assemblies, used in other devices.

The evaporator module of the refrigerator unit and/or freezer unit in accordance with the invention can be arranged in an upper region of the inner space, i.e. directly beneath the top of the inner container and can thus form the upper termination of the inner space of the refrigerator unit and/or freezer unit.

The invention furthermore relates to a refrigerator unit and/or a freezer unit comprising illumination means by means of which the inner space of the unit and/or the region located in front of the inner space of the unit from the viewpoint of the user can be at least partly illuminated, with the unit being characterized in that the illumination means are formed by one or more LEDs or include one or more LEDs.

As stated above, LEDs bring along the advantage that they are small and have a comparatively low heat emission so that they can also be used effectively in tight space conditions. A further advantage lies in the fact that by means of LEDs light can be focused directly in specific regions such as in drawers which should preferably be illuminated.

BRIEF DESCRIPTION OF THE DRAWINGS

Further details and advantages of the invention will be explained in more detail with reference to an embodiment shown in the drawing. There are shown.

DESCRIPTION OF THE PREFERRED EMBODIMENTS

Figure 1:
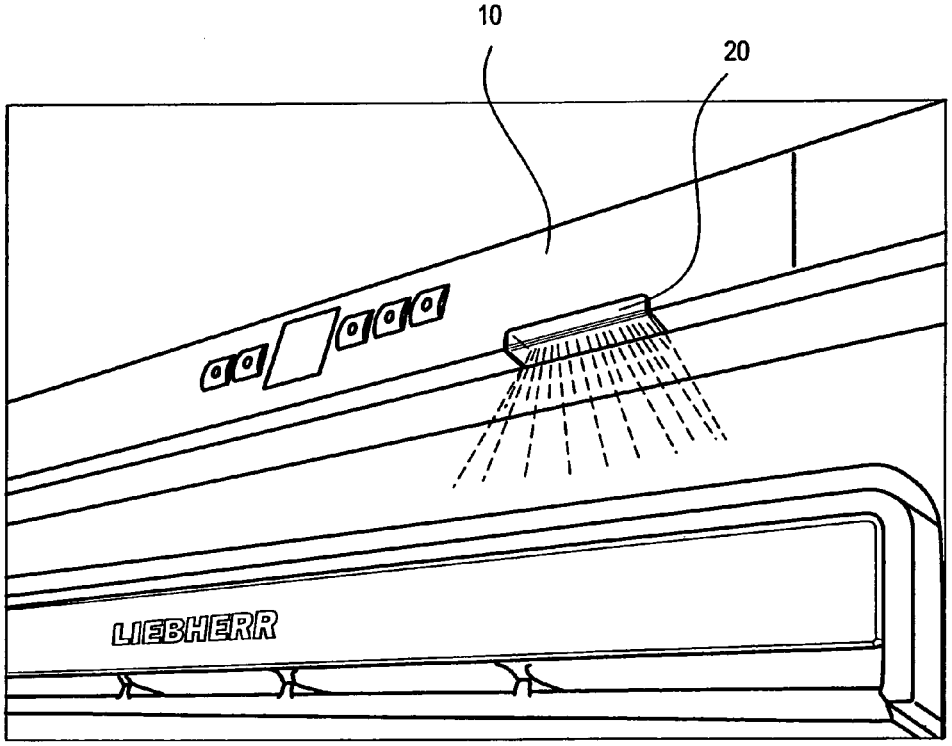
FIG. 1: a perspective view of the upper region with operating and control unit of a refrigerator unit and/or a freezer unit in accordance with the invention with an open door.

FIG. 1 shows an operating and/or control unit of a freezer in accordance with the invention with the reference numeral 10. The operating and/or control unit 10 is located at the level of the upper end region of the door and is dimensioned such that it is not visible with an open door, but is rather hidden by the upper end region of the door. Embodiments are naturally equally conceivable in which the operating and/or control unit is arranged such that it is located above the closed door, i.e. is accessible with a closed door.

Figure 2:
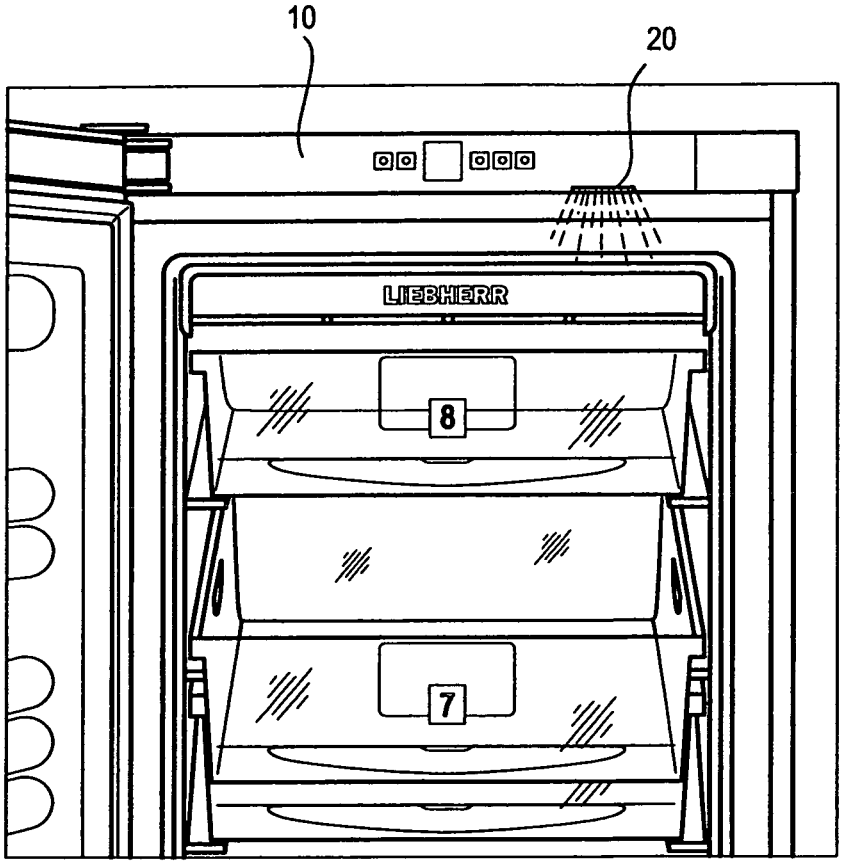
FIG. 2: a frontal view of the upper region of the unit in accordance with FIG. 1.

The operating and/or control unit 10 has a panel which forms the front side, the lower side and the upper side of the operating and/or control unit 10. A cut-out 20 is located at the lower side of the panel. Illuminants made as LEDs are located in the panel or in the operating and/or control unit 10. As can be seen from FIGS. 1 and 2, the LEDs are arranged such that they emit light downwardly through the cut-out 20 located in the lower side of the panel and thus illuminate the inner space of the refrigerator unit and/or freezer unit as well as the region located in front of the inner space from the viewpoint of the user, in particular the inner space of pulled out drawers or of pulled out trays, as can in particular be seen from FIG. 2.

Figure 3:
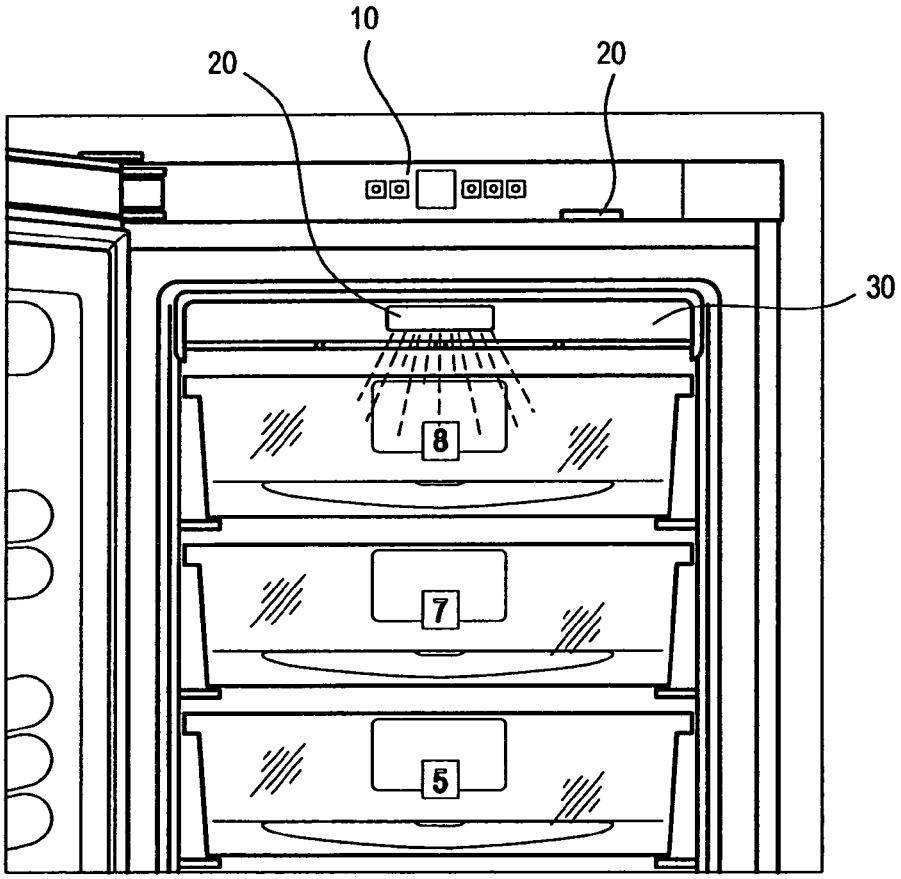
FIG. 3: a frontal view of the upper region of a refrigerator unit and/or a freezer unit in accordance with the present invention in a further embodiment.

In FIG. 3, an embodiment of the present invention is shown in which an illumination unit made with one or more LEDs is arranged in the evaporator module 30 which is located at the uppermost point in the inner container of the freezer unit, with light being emitted downwardly and/or to the front by means of said illumination unit. It is possible in this way to illuminate the inner space of the refrigerator unit and/or freezer unit and/or of the region located in front thereof.

Provision can naturally generally also be made that the illumination is arranged in the evaporator module 30 at its lower side so that the light is primarily emitted downwardly.

If transparent trays or drawers are used, the advantage results that the light also passes through them into lower regions of the inner unit space.

The illumination means of the refrigerator unit and/or freezer unit in accordance with the invention can be made movable such that the illuminated region can be changed by the user so that particularly preferred regions of the unit can be illuminated.

The invention claimed is:

1. A refrigerator unit and/or a freezer unit comprising
a cooling space,
an evaporator module for the cooling of the inner space and arranged above the cooling space, and
illumination means by which the inner space of the unit and/or a region located in front of the inner space of the unit from the viewpoint of the user can be illuminated at least partly, wherein
the illumination means are arranged in or at the evaporator module wherein the evaporator module has a cut-out, and the illumination means are arranged in or at the evaporator module such that they emit light through the cut-out.

2. The refrigerator unit and/or the freezer unit in accordance with claim 1, wherein the illumination means are formed by one or more LEDs or include one or more LEDs.

3. The refrigerator unit and/or the freezer unit in accordance with claim 1, wherein the operating and/or control unit is located outside or inside the inner space of the refrigerator unit and/or the freezer unit.

4. The refrigerator unit and/or the freezer unit in accordance with claim 1, wherein the illumination means are located on the lower side or on the front side of the evaporator module; or the illumination means are located inside the evaporator module and are arranged such that they emit light through a cut-out in the lower side or front side of the evaporator module.

5. The refrigerator unit and/or the freezer unit in accordance with claim 1, wherein the evaporator module has a panel which forms at least the front-side cover of the evaporator module.

6. The refrigerator unit and/or the freezer unit in accordance with claim 5, wherein the illumination means are arranged in or at the panel.

7. The refrigerator unit and/or the freezer unit in accordance with claim 1, wherein the evaporator module has a panel which forms at least the front-side cover of the evaporator module, and the cut-out is arranged in the panel.

8. The refrigerator unit and/or the freezer unit in accordance with claim 1, wherein the illumination means or an illumination unit which includes the illumination means terminates flush with the evaporator module or the panel or is raised with respect thereto.

9. The refrigerator unit and/or the freezer unit in accordance with claim 1, wherein two illumination means or more than two illumination means are provided which are arranged at an angle to one another such that they emit light in different directions.

10. The refrigerator unit and/or the freezer unit in accordance with claim 1, wherein the evaporator module has a panel made of transparent material.

11. The refrigerator unit and/or the freezer unit in accordance with claim 10, wherein the panel is printed, lacquered or otherwise covered in the regions in which transparency of the panel is not required.

12. The refrigerator unit and/or the freezer unit in accordance with claim 1, wherein logos, symbols, prints and the like can be illuminated by backlighting in the evaporator module.

13. The refrigerator unit and/or freezer unit of claim 1, further comprising:

at least one operating and/or control unit for the operation and/or control of the refrigerator unit and/or freezer unit, wherein the illumination means are also arranged in or at the operating and/or control unit, logos, symbols, and/or prints are illuminated by backlighting in the operating and/or control unit and/or in the evaporator module, and the backlighting is realized by scattered light or by light conductors.

14. The refrigerator unit and/or the freezer unit in accordance with claim 1, wherein the illumination means are connected to an electrical assembly which controls or supplies at least one further component in addition to supplying the illumination means.

15. The refrigerator unit and/or the freezer unit in accordance with claim 1, wherein the illumination means are integrated on an already present board of the unit.

16. The refrigerator unit and/or the freezer unit in accordance with claim 1, wherein the evaporator module forms the upper wall of the inner space of the unit.

17. A refrigerator unit and/or a freezer unit comprising at least one operating and/or control unit for the operation and/or control of the refrigerator unit and/or freezer unit, a cooling space, and illumination means by which the inner space of the unit and/or a region located in front of the inner space of the unit from the viewpoint of the user can be illuminated at least partly, wherein the illumination means are arranged in or at the operating and/or control unit which is formed as a front-side trim located in a region above the cooling space and concealed when a door of the unit is closed, and the illumination means are formed by at least one LED.

18. The refrigerator unit and/or the freezer unit in accordance with claim 17, wherein the unit has a door which covers the operating and/or control unit in the closed state.

19. A refrigerator unit and/or a freezer unit comprising:

a) a cooling space;

b) at least one evaporator module for the cooling of the inner space and arranged above the cooling space;

c) illumination means by which the inner space of the unit and/or a region located in front of the inner space of the unit from the viewpoint of the user can be illuminated at least partly, wherein the illumination means are arranged in the evaporator module.

* * * * *